US006460223B1

(12) United States Patent
Pinto

(10) Patent No.: US 6,460,223 B1
(45) Date of Patent: Oct. 8, 2002

(54) FIBER WEB FOR NON-WOVEN FABRIC FORMING APPARATUS

(76) Inventor: Akiva Pinto, P.O. Box 1100-171, Gastonia, NC (US) 28053-1100

( * ) Notice: Subject to any disclaimer, the term of this patent is extended or adjusted under 35 U.S.C. 154(b) by 0 days.

(21) Appl. No.: 09/977,814

(22) Filed: Oct. 15, 2001

Related U.S. Application Data

(63) Continuation-in-part of application No. 09/852,514, filed on May 10, 2001, which is a continuation-in-part of application No. 09/760,925, filed on Jan. 16, 2001, now Pat. No. 6,276,028, which is a continuation-in-part of application No. 09/505,922, filed on Feb. 17, 2000, now Pat. No. 6,263,545.

(51) Int. Cl.[7] ..... D01G 15/02

(52) U.S. Cl. ..... 19/105; 19/97.5; 19/200; 19/205

(58) Field of Search ..... 19/65 A, 92, 97, 19/90, 97.5, 98, 100, 105, 106 R, 145.5, 145.7, 161.1, 200, 203, 204, 205, 225, 300, 302, 303, 304

(56) References Cited

U.S. PATENT DOCUMENTS

| | | | | |
|---|---|---|---|---|
| 4,240,180 A | | 12/1980 | Wood et al. | 19/105 |
| 4,387,486 A | | 6/1983 | Keller et al. | 19/105 |
| 4,520,530 A | * | 6/1985 | Pinto | 19/105 |
| 4,657,444 A | | 4/1987 | Pinto | 406/23 |
| 4,682,388 A | | 7/1987 | Pinto | 19/105 |
| 4,694,538 A | | 9/1987 | Pinto et al. | 19/105 |
| 4,700,431 A | | 10/1987 | Artzt et al. | 19/105 |
| 4,858,277 A | | 8/1989 | Pinto et al. | 19/200 |
| 5,156,743 A | | 10/1992 | Munerief | 210/671 |
| 5,343,597 A | | 9/1994 | Pinto et al. | 19/205 |
| 5,950,282 A | | 9/1999 | Pinto | 19/97.5 |
| 6,263,545 B1 | * | 7/2001 | Pinto | 19/97.5 |
| 6,276,028 B1 | * | 8/2001 | Pinto | 19/105 |

* cited by examiner

*Primary Examiner*—Danny Worrell
*Assistant Examiner*—Gary L. Welch
(74) *Attorney, Agent, or Firm*—McNair Law Firm, P.A.

(57) ABSTRACT

An apparatus for forming a non-woven fiber web of fibrous material which includes a mixing chamber from which the blended fibers are fed into the fiber web forming chute where they are formed into a fiber web. The web forming chute includes a packing belt and a vibrating assembly each driven at selected speeds to compact the fibers into a fiber web of desired density. Volume dependent controls within the web forming chute act to control the rate of the feed rolls and the beater roll while weight or density dependent controls outside the web forming chute act to control the rate of the packing belt, the vibrating assembly and the size of the fiber web forming chute.

13 Claims, 1 Drawing Sheet

FIBER WEB FOR NON-WOVEN FABRIC FORMING APPARATUS

This is a continuation-in-part of my earlier filed application Ser. No. 09/852,514, filed on May 10, 2001, which is a continuation-in-part of Ser. No. 09/760,925, filed on Jan. 16, 2001, now U.S. Pat. No. 6,276,028, which is a continuation-in-part of Ser. No. 09/505,922, filed on Feb. 17, 2000, now U.S. Pat. No. 6,263,545.

BACKGROUND OF THE INVENTION

Apparatus of this invention relates to fiber feeding, blending and forming of fiber webs of selected density and thickness. The apparatus features controls for varying the rate of feed between multiple sources for varying the blending and feeding to control the density of the fiber web being formed. The arrangement is an improvement over U.S. Pat. No. 5,950,282, issued Sep. 14, 1999, the disclosure of which is incorporated herein.

Fiber blending and fiber web forming systems are well-known in the industry. Various contemporary arrangements are shown in U.S. Pat. Nos. 4,694,538; 4,657,444; and 4,520,530. None of these patents teach the system of controlled blending and controlled fiber web density as herein disclosed.

The invention has for an object a blending system which receives fibers from a plurality of sources at controlled rates.

Another object of the invention is an improved multi-source fiber feeding and blending system.

Another object of the invention is a controlled feed for delivery of fibers of a selected blend to a beater.

Another object of the invention is a fiber web forming chute which provides a positive drive for movement of the fibers into a compacted fiber web.

Another object of the invention is a fiber web forming chute which may be adjusted to accommodate different thicknesses or density variations.

Another object of the invention is a control system responsive to sense fiber volume in the web forming chute and being responsive to change the fiber volume to desired levels.

Another object of the invention is a control system operative to change the size of the web forming chute in accordance with a selected fiber volume and web fiber density.

Another object of the invention is a variable speed, positive feed for the fiber web forming chute.

Another object of the invention is a control system, which in response to unwanted fiber web density sensings, acts to bring about change of density in subsequent fiber webs being formed.

SUMMARY OF THE INVENTION

The instant invention is directed to an apparatus for forming a non-woven fiber web or non-woven fabric of fibrous material. The apparatus includes a feed having a plurality of feed chutes for feeding fibers from a plurality of sources. The discharge ends of the feed chutes connect with a housing which includes a mixing chamber, a beater chamber and a fiber web forming chute.

The mixing chamber includes a feed roll adjacent each discharge end of each feed chutes which withdraw the fibers from the feed chutes and deliver them into the mixing chamber. Preferably, the feed rolls are of different diameters.

A combing roll within the mixing chamber acts to move the fibers from the mixing chamber into a beater roll chamber which further blends and opens the fibers during delivery to the web forming chute.

The system may provide independent drives for each of the feed rolls, the comber roll and the beater roll, which drives are capable of being controlled to drive each roll at selected peripheral speeds.

The feed rolls, the combing rolls and the beater rolls each have protruding teeth forming their outer surfaces. The teeth forming the surface of at least one of the rolls form a helical bite.

The system includes a control which is capable of causing each drive to drive its particular roll at selected RPM's.

The fiber web forming apparatus of the invention includes a fiber web forming chute which receives the mixed fibers from the beater roll and forms them into a fiber web. The web forming chute includes an upper and a lower wall, a delivery end and a receiving end. A packing belt extends from the vicinity of the receiving end to the vicinity of the delivery end and forms at least a portion of one of the upper and lower walls.

An independent drive is provided for driving the packing belt in the direction of the delivery end.

A vibrating plate is located in and forms at least a portion of the other of the upper and lower walls, preferable the upper wall. An independent drive is provided for driving the vibrating plate.

The fiber web forming chute includes a mounting structure which acts to adjustably position the packing belt relative to the vibrating plate.

A control is provided to selectively position the packing belt in response to the selected volume of fibers fed into the web forming chute and the selected density of the fiber web being formed.

A compression roll is located adjacent the delivery end of the web forming chute. The compression roll acts to further compress the fibers forming the fiber against a delivery surface during its exodus from the web forming chute. The compression roll mounting structure permits movement of the compression roll relative to the delivery surface in dependence upon the density of the fiber web emerging from the delivery end. A control which varies the operational speed of the drive of at least one of the packing belt and the vibrating plate responsive to the position of the compression roll is provided. The movement of the compression roll as controlled by the density of the fiber web operates the control to vary the speed of at least the packing belt.

A conveyor receives the fiber web emerging from the fiber web forming chute and the compression roll. The conveyor includes a scale for weighing the fiber web during delivery to further processing. The scale is effective to signal a control which, in response to the signal, controls the operational speed of at least one of said packing belt and said vibrating plate.

The web forming chute includes a sensor which detects an absence of fibers in the web forming chute or an excess of fibers in the web forming chute. The sensor is connected with a control which acts to control at least one of the feed roll, the comber roll and the beater roll drives and is operative to selectively adjust the peripheral speed of each of these rolls in dependence upon these sensings.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 2:
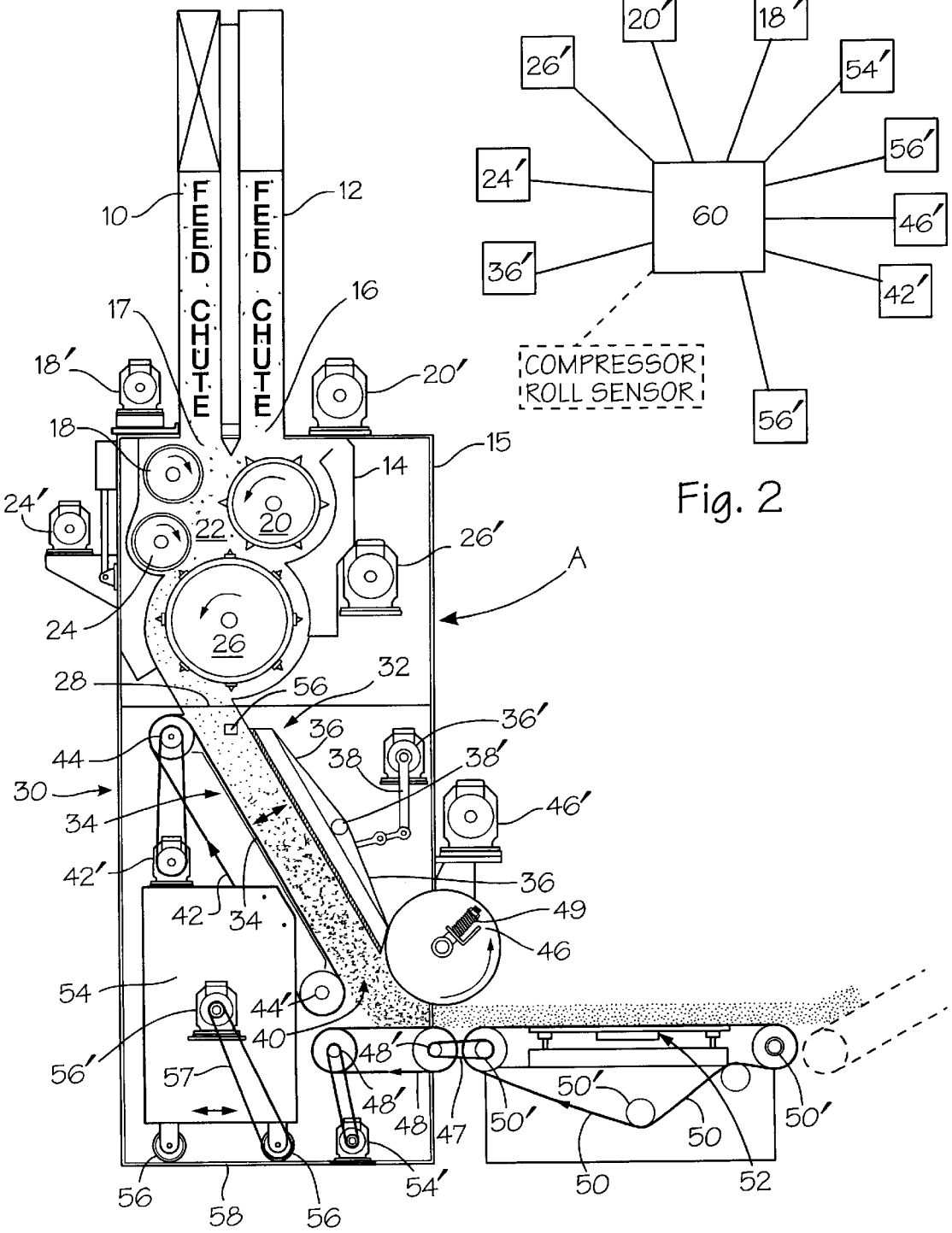
FIG. 1 is a side view of the fiber feed, blending and fiber web forming apparatus of the invention.
FIG. 2 is a block diagram of the control which maintains the roll drives at selected drive speeds in response to fiber quantity and fiber baft density.

Turning now to the drawings, a pair of feed chutes 10, 12 are shown connecting with housing 14 formed within cabinet A. Preferably each feed chute 10, 12 is connected with a fiber feed apparatus as disclosed in U.S. Pat. No. 5,950, 282.

Fiber discharge openings 16, 17 are arranged in the upper surface of housing 14. Feed roll 18 is located adjacent opening 17 and rotates in a clockwise direction. Feed roll 20 is located adjacent opening 16 and rotates in a counter clockwise direction. Preferably, the diameter of feed roll 18, which is about 6 inches in diameter, is about half the diameter of feed roll 20.

Feed rolls 18 and 20 are driven by independent drive motors 18', 20' which are each controlled to selectively drive the feed rolls at selected RPM's. The speed selected is determined by sensors, to be discussed further on, which, in most instances, control feed rolls 18 and 20 to have the same peripheral speed. A median peripheral speed for feed rolls 18 and 20 is between 0 and 20 m/min. In cases where the fiber mixture from chutes 10 and 12 is to be varied, the peripheral speed between rollers 18 and 20 is adjusted as required.

The feed rolls deliver the fibers into mixing chamber 22 where they are further opened and blended. At the lower end of mixing chamber 22 there is located a combing roll 24 and a beater roll 26. Combing roll 24 along with feed roll 20 act to pick up fibers in the mixing chamber and wipe them onto the outer surface of the beater roll. The beater roll in turn acts to further open and blend the fibers as they are moved through the beater chamber during delivery into receiving end 28 of web chute 30.

Comber roll 24 and beater roll 26 are driven by motors 24' and 26' at selected speeds.

The peripheral surfaces of feed rolls 18, 20 of comber roll 24 and of beater roll 26 are formed of pin like members of usual construction. Normally, the pins are arranged in parallel transverse rows, however, in the case of at least feed roll 20, it has been found to be desirable to arrange the pin rows in a helical pattern. Such a pattern of teeth acts to more evenly wipe the fibers onto beater roll 26.

Web forming chute 30 is of usual rectangular shape with an upper wall 32 and a lower wall 34 spaced by a pair of equal sized sides. Upper wall 32 includes a vibrating plate 36. Vibrating plate 36 extends across the width of upper wall 32 and lengthwise of web forming chute 30 from adjacent the upper end of wall 32 to the end of web forming chute 30. Vibrating plate 36 forms the upper surface of discharge or delivery end 40 of the web forming chute. Vibrating plate 36 is driven in a rocking motion about pivot 38' by motor 36' through linkage 38. The structure of web forming chute 30 maintains vibrating plate 36 in substantially fixed positioned relative to lower wall 34. Vibrating plate 36 acts to assist in the flow or movement of fibers fed through receiving end 28 toward and through delivery end 40.

Lower wall 34 includes packing belt 42 which extends over substantially its entire area. Packing belt 42, which is continuous, passes around roller 44 which is arranged near the upper end of lower wall 34 and around the roller 44', which is arranged at delivery end 40 of the web forming chute. Motor 42' drives roller 44 and packing belt 42 in a clockwise direction. The packing belt acts to physically assist the movement of the fibers, which until this point are fed by gravity, down the packing chute forming the fiber web of more evenly blended fibers in the lower portion of the web forming chute.

Lower wall 34, to include rollers 44, 44' packing belt 42 and motor 42' are formed as an integral unit supported by carriage 54 which is located within cabinet A. Carriage 54 includes four wheels 56 (only two of which are shown) which are supported by a pair of tracks 58 (only one of which is shown). Tracks 58 are parallel and function along with carriage 54 to maintain lower wall 34 parallel with upper wall 32 at all times.

Carriage 54 mounts on its upper surface lower wall 34 and motor 42' which drives packing belt 42. The carriage also mounts motor 56' which connects by any suitable drive means, such as belt 57, with at least one of wheels 56 for moving and maintaining positioned carriage 54 along tracks 58 in a positive manner. It is noted that wheels 56 and tracks 58 could be a rack and pinion system or simply a slide system.

In operation motor 56', which is actuated and de-actuated by control 60, acts to position the lower wall relative to upper wall 32. The relative spacing of these walls allows the fiber webs to be formed at varying thicknesses and with varying resilience as determined by the selected fiber density of the fiber web being formed.

Compression roll 46, which is driven by motor 46', acts to compress and draw the formed fiber web out of delivery end 40 of the web forming chute.

A conveyor belt 48, arranged adjacent delivery end 40, receives the fiber web emerging from the delivery end. Conveyor belt 48, which passes around rollers 48', acts as a back wall against which compression roll 46 compresses the fiber web and as a delivery belt for moving the formed fiber baft onto conveyor belt 50.

Conveyor belt 50 passes about rollers 50'. Motor 54', which is connected with a roller 48', also drives conveyor belt 50 through drive belt 47.

Mounted intermediate rollers 50' is a scale 52 which acts to weigh the fiber emerging from delivery end 40 as it is moved over conveyor belt 50. The weight of the formed fiber web is sent to control 60 which calculates its density and compares this density to the selected norm.

Another method for determining the density of the fiber web being formed is to mount compression roll 46 in slots which are arranged at an incline relative to conveyor surface 48. Resilient members 49 urge compression roll 46 in the direction of the emerging fiber web, further compressing it.

A photoelectric sensor is positioned along the slot and acts to determine the position of the compression roll within the slot. The position of compressor roll 46 in the slot is determined by the density of the fiber web. The sensored position is sent to control 60 which calculates the density of the fiber web and compares it to the selected norm.

The volume of fibers within web forming chute 30 is determined by sensor 5 which is an ultrasonic sensor designed to deliver a first signal to control 60 when the fiber volume is insufficient and a second signal to control 60 when the fiber volume is in excess. Again sensor 5 may be any type of density sensor.

Turning now to FIG. 2, a block diagram of the control system is shown. Control 60, which may be a computer, is connected with fiber volume sensor 5 and sensor 52. Control 60 is also connected with motor 18', motor 20', motor 24', motor 26', motor 36', motor 42', motor 54' and motor 56'. Control 60 may also be connected with the compression roll sensor.

In operation, fibers from two sources are fed through feed chutes 12 into mixing chamber 22. The relative peripheral speeds of feed rolls 18 and 20 are set at predetermined rates. Control 60 provides signals which control motors 18' and 20' to a selected speed.

The opened and blended fibers are moved from the mixing chamber by combing roll 24 and beater roll 26 into receiving end 28 of web forming chute 30. The combing roll and beater are driven at a selected speed by motors 24' and 26' which are under the control of control 60. Packing belt 42 and vibrating plate 36 assist in moving the free falling fibers down web forming chute 30 forming a fiber web in the lower portion thereof. Motors 36' and 42', also under the control of control 60, move the packing belt and vibrating plate at desired and relative speeds.

In operation, control 60 is instructed or programmed to deliver a fiber web of a pre-selected fiber blend, density and thickness. Control 60 then acts to determine the speed individually of motors 18', 20', 24' and 26' to control the RPM's of rolls 18, 20, 24 and 26 to deliver the proper blend and volume of fiber delivered to receiving end 28 of fiber web forming chute 30. Likewise, control 60 acts to determine the speed of motors 36', 42', 46', and 54' to control the speed of packing belt 42, vibrating plate 36, compression roll 46 and belt 48 at pre-selected speeds.

Sensor 5 through control 60 assures that a proper fiber volume is maintained within web forming chute 30. Control 60 further controls motor 56' to position carriage 54, and therefore position lower wall 34 in the pre-selected position relative to upper wall 32 to provide for the formation of the fiber web of the density selected.

The formed web moves past compression roll 46 and onto belt 50. As the formed roll passes scales 52 its actual weight, which equals density, is accessed. Scale 52 signals the fiber web's weight to control 60, which compares the actual weight against the selected density, and acts to control or adjust the RPM's of motors 42', 36', 46', 54', and 56' individually to bring the fiber web to the density selected.

It is noted that a sensor associated with compressor roll 46 as earlier discussed could be utilized to bring about these changes.

It is noted that the upper wall and lower wall structures described are those preferred. It is noted that other upper and lower wall structures such as those disclosed in co-pending application Ser. No. 09/852,514 could also be adapted to utilize the disclosed wall positioning arrangement disclosed.

While preferred arrangements of the invention has been described using specific terms, such description is for illustrative purposes only, and it is to be understood that changes and variations may be made without departing from the spirit or scope of the following claims.

What is claimed is:

1. Apparatus for forming a fiber web including:

a fiber feed operative at a selected rate;

a fiber web forming chute receiving fibers from said fiber feed having an upper wall and a lower wall in selected spaced positions;

a carriage supporting one of said upper and lower walls in selected of said spaced positions;

fiber contacting members arranged along said upper and lower walls and driven at individual selected speeds for forming said fibers into a fiber web and moving said fibers and fiber web through said fiber web forming chute;

testing apparatus for testing said formed fiber web departing said fiber web forming chute;

a control associated with a plurality of drives for controlling fiber movement into and through said web forming chute and for controlling said carriage to position said one wall in a selected of said spaced positions, said control receiving results from said testing apparatus and comparing said results against a norm; wherein said control, in response to said comparison, causes at least one of said fiber feed, said carriage locating said upper and lower walls and said selected speed of said fiber contacting members to change.

2. The apparatus of claim 1 wherein said at least one comprises said carriage.

3. The apparatus of claim 1 wherein said web forming chute has a longitudinal axis and includes said upper wall mounted in fixed position relative to said longitudinal axis.

4. The apparatus of claim 3 wherein said carriage mounts said lower wall of said web forming chute.

5. The apparatus of claim 1 wherein said fiber contacting member comprises a packing belt carried by said lower wall.

6. The apparatus of claim 5 wherein said carriage includes four tracks mounted wheels.

7. The apparatus of claim 1 wherein said carriage includes a motor operative to locate and maintain said carriage in said selected positions relative to said upper wall.

8. A method of forming a fiber web of pre-selected density comprising:

selectively feeding fibers into a mixing chamber and mixing said fibers;

moving said fibers into a fiber web forming chute of pre-selected size;

engaging said fibers within said fiber web forming chute and moving said fibers through said fiber web forming chute at a pre-selected rate forming a fiber web;

testing said fiber web to determine its density and comparing that density with said pre-selected density; and adjusting said rate of movement of fibers through said fiber web forming chute and the size of said fiber web forming chute in response to said comparison to accommodate a fiber web density change dictated by said comparison.

9. The method of claim 8 including adjusting the rate, of feed of said fibers into a mixing chamber.

10. A method of forming a fiber web of pre-selected density comprising:

feeding fibers at a pre-selected rate into a fiber web forming chute having upper and lower surfaces spaced at a pre-selected distance; and providing a fiber moving device along one of said surfaces and causing said fiber moving device to move at a pre-selected rate;

testing said fiber web to determine its density and comparing that density with said pre-selected density; and, adjusting the position of said fiber moving device relative to the other of said surfaces when necessary to maintain said web density at said pre-selected web density.

11. The method of claim 10 including adjusting the rate of movement of fibers through said fiber web forming chute.

12. The method of claim 10 including adjusting said pre-selected rate of feeding said fibers.

13. The method of claim 10 including adjusting said preselected rate of movement of said fiber moving device.

* * * * *